United States Patent [19]

Kampe

[11] 4,334,148

[45] Jun. 8, 1982

[54] PTC HEATERS

[75] Inventor: Andrew J. Kampe, Half Moon Bay, Calif.

[73] Assignee: Raychem Corporation, Menlo Park, Calif.

[21] Appl. No.: 869,786

[22] Filed: Jan. 16, 1978

Related U.S. Application Data

[63] Continuation of Ser. No. 608,660, Aug. 28, 1979, abandoned.

[30] Foreign Application Priority Data

Aug. 30, 1974 [GB] United Kingdom ..... 38059/74

[51] Int. Cl.[3] ..... H05B 3/12

[52] U.S. Cl. ..... 219/553; 219/528; 219/504; 219/548; 252/511; 338/22 R; 338/331; 264/105

[58] Field of Search ..... 219/504, 505, 510, 518, 219/528, 548, 549, 553; 338/20, 22 R, 22 SA, 25, 212, 322, 214, 331; 29/611; 264/22, 105; 428/204; 252/511, 512, 520; 174/DIG. 8

[56] References Cited

U.S. PATENT DOCUMENTS

| | | | |
|---|---|---|---|
| 2,373,160 | 4/1945 | Bollman et al. | 338/22 R |
| 3,344,385 | 9/1967 | Bartos et al. | 338/212 |
| 3,793,716 | 2/1974 | Smith-Johannsen et al. | 29/611 |
| 3,823,217 | 7/1974 | Kampe | 264/105 |
| 3,858,144 | 12/1974 | Bedard et al. | 338/22 R |
| 3,861,029 | 1/1975 | Smith-Johannsen et al. | 338/214 X |
| 3,900,654 | 8/1975 | Stinger | 428/214 |
| 4,055,526 | 10/1977 | Kiyokawa et al. | 219/528 X |
| 4,058,704 | 11/1977 | Shimizu | 219/518 |
| 4,177,376 | 12/1979 | Horsma et al. | 338/22 R X |
| 4,188,276 | 2/1980 | Lyons et al. | 204/159.17 |

OTHER PUBLICATIONS

*Webster's New World Dictionary of the American Language,* The World Publishing Co., 1972, p. 498.

*Primary Examiner*—Volodymyr Y. Mayewsky
*Attorney, Agent, or Firm*—Lyon & Lyon

[57] ABSTRACT

A self-regulating electrical heater comprised of a material which exhibits a positive temperature coefficient of resistance. The heater has a generally rectangular cross-section which provides greater thermal stability and reduces the number of hotline failures.

2 Claims, 1 Drawing Figure

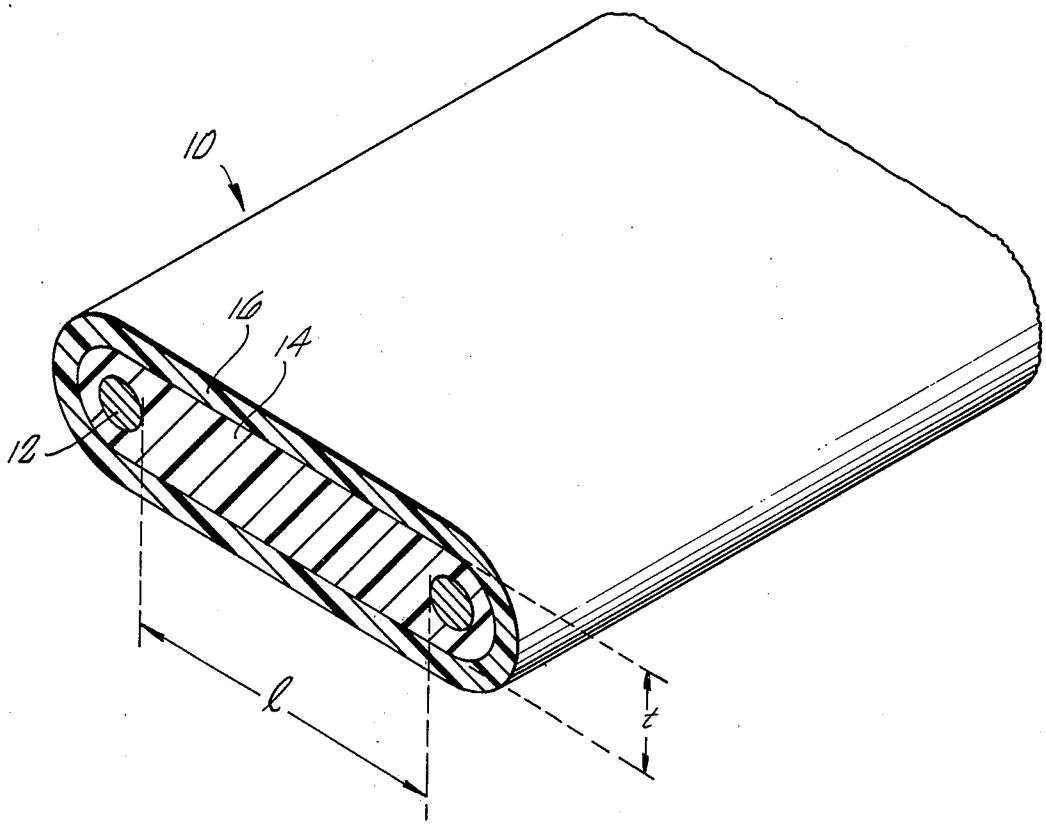
10
16
14
12
ℓ
t

PTC HEATERS

This is a continuation of application Ser. No. 608,660, filed Aug. 28, 1979, now abandoned.

BACKGROUND OF THE INVENTION

This invention relates to an improved self-regulating electrical heating element and, in particular, relates to an improved self-regulating electrical heating element comprised of a material which exhibits a positive temperature coefficient of resistance.

A positive temperature coefficient of resistance may be defined as a substantial increase in the electrical resistance of a material with a small increase in the temperature of the material beyond a specified temperature. Compositions exhibiting a positive temperature coefficient of resistance are frequently referred to as PTC compositions. The resistance-temperature dependence of a typical PTC composition can be graphically depicted as follows:

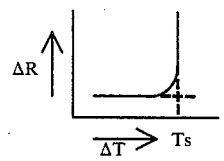

With reference to the diagram, it can be seen that in the first stages of heating PTC composition, the increase in resistance is small. However, at the temperature designated $T_S$, further heating causes a rapid increase in resistance as indicated by the large increase in the slope of the curve. The temperature $T_S$ is often designated as the switching or anomaly temperature.

Some of the history and theory of PTC materials is discussed by Meyer, "Glass Transition Temperature as a Guide to Selection of Polymers Suitable for PTC Materials," Polymer Engineering and Science, November 1973, Volume 13, No. 6. Other discussions of the characteristics of PTC material are found in Kampe U.S. Pat. No. 3,823,217 issued in July, 1974, Kohler et al U.S. Pat. No. 3,351,882, issued November, 1967, and in an article by Ting, "Self-Regulating PTC Systems," Texas Instruments Publication, 1971 (recommended by IEEE Domestic Appliance Committee for presentation at the 22nd annual Appliance Technical Conference, Chicago, Illinois, May 4 and 5, 1971). The disclosures of these references are incorporated herein.

In recent years, PTC compositions have been employed as components in self-regulating electrical heaters. One prior heating element was formed as a thin strip capable of being wrapped around a substrate. Such element was used to heat tubular or irregular conduits or vessels, for example, to thaw their contents, to prevent the salting out of solids in solution, etc. The element was comprised of PTC materials disposed between two electrodes formed at opposite sides of the strip and running parallel down the length of the strip. An insulating material was disposed around the outside of the strip. In operation, the electrodes were energized and a potential gradient was formed along the plane of the strip transverse to its longitudinal axis. At a constant applied voltage directed across the PTC material, the current ($I=V/R$) through the heater was large at low temperatures. The power (P) generated by this current ($P=I^2R$) was dissipated as joule heat thereby warming the PTC composition. If the applied voltage was high enough, the temperature continued to rise without a significant increase in resistance until the $T_S$ temperature was reached. At this point, a further increase in temperature of the material resulted in a significant increase in resistance. Since the applied voltage was constant, the further increase in temperature resulted in a corresponding decrease in current and therefore in power generation. In effect, the heater was switched off.

In operation, the heat built up in the PTC composition was dissipated by heating its surroundings until its temperature dropped below $T_S$ at which point the power output of the heater again rose. In actual practice, a steady state condition was attained at about the $T_S$ temperature as heat loss to the surrounding was offset by heat being generated within the PTC composition. The net effect was that the power being generated by the current in the PTC composition remained relatively constant as did its heat output. Unfortunately, in some cases, prior art strip PTC heaters have experienced thermal instabilities. Thermal instabilities have resulted in the formation of non-uniform areas of resistance in the PTC material. For example, thermal instability has resulted in the formation of "hotlines" in the heater. The hotline effect is the formation of a narrow band in the PTC material having a higher temperature than the surrounding PTC material. This band has a correspondingly higher resistance than the surrounding cooler PTC material. The band ran generally parallel to and between the electrodes and normally ran down the entire length of the strip. The current flow through the PTC material caused the band to heat up at a faster rate than the surrounding PTC material. Even though the total current flow through the heater decreased as the temperature of the band increased, the increase in the resistance of the band still caused the band to heat up at an even faster rate than the surrounding PTC material. In this way, the band became even hotter and in some cases, the instability grew to a point where almost all of the joule heat generated in the strip came from the band. In extreme cases this caused a burn out of the insulating jacket and failure of the heater.

Prior art solution to the hotline problem involved forming the PTC heaters having generally dumbbell-shaped cross-section with the central layer of PTC material formed as thin as possible to enable efficient uniform heat dissipation normal to the plane of the strip to prevent the hotline effect. Unfortunately, these heaters still experience hotlines.

It has been found that the hotline problem may be mitigated by increasing the relative thickness of the central portion of the PTC material in relation to the distance between the electrodes.

SUMMARY OF THE INVENTION

It is therefore an object of the present invention to provide a PTC strip heater which has improved thermal stability.

This and other objects and advantages are obtained by forming a PTC strip heater comprising PTC material, two electrodes and an insulating material. The electrodes are preferably wires longitudinally disposed in parallel spaced-apart relationships along either side of the strip. The PTC material is disposed between the electrodes and the insulating material is then formed around the external portion of the strip. The cross section of the heater is generally rectangular having a generally uniform thickness of PTC material disposed therein. The increased thickness of the PTC material provides greater thermal stability and prevents hotlines.

A more thorough disclosure of the objects and advantages of the present invention is presented in the detailed description which follows and from the accompanying drawing which is a perspective cross-sectional view of a PTC strip heater according to the present invention.

DETAILED DESCRIPTION OF THE INVENTION

The present invention contemplates the formation of an elongated, self-regulating PTC heater having a generally rectangular cross-section. Referring to the drawing, there is shown a PTC heater 10 according to the present invention comprising generally two electrodes 12, PTC material 14 and insulating material 16.

Describing now the various elements of the heater in more detail, the electrodes 12 are preferably copper wires disposed in a parallel spaced-apart relationship along the edge of the strip. The PTC material 14 is a semi-conductive composition preferably consisting of conductive carbon black particles dispersed in an insulative polymeric base. PTC materials suitable for the practice of the present invention are disclosed in Lyons copending U.S. patent application filed Aug. 4, 1975 Ser. No. 601,550, now U.S. Pat. No. 4,188,276, which is assigned to the same assignee as the present application and in the previously cited Kampe U.S. patent, the disclosures of which are incorporated herein by reference.

The PTC heaters may be manufactured by extruding the PTC material between and around the two wire electrodes and then extruding the insulating material over the PTC material to form the strip heater.

The cross-sectional geometry of the PTC heater according to the present invention is significant. The web of the strip is defined as the PTC material disposed between the two electrodes. Defining the distance between the facing surfaces of the electrodes as lateral length (1) and the thickness of the web midway between the two electrodes as t, the cross-sectional geometry of the heater may be defined as having an 1/t ratio less than 5. Furthermore, the heater has a web thickness which is greater than the maximum dimension of the electrode in the t direction. It has been found that strip PTC heaters having a cross-sectional geometry in accordance with the above specification exhibit more thermal stability and experience fewer hotline failures than the previously used dumbbell type strip heaters.

Although the rational for the successful results of the present invention are not fully understood, it is believed that by increasing the thickness of the web, the heat generated at the center of the web is transferred primarily to laterally adjacent PTC material rather than to the adjacent substrate thereby enabling a more efficient dissipation of the joule heat.

The invention thus provides a ratio of thermoconductances in the directions between the centers of the electrodes and perpendicular thereto. The thermoconductance of the PTC material in the direction 1 between the electrodes may be expressed as:

$$K_1 = H\frac{A_1}{1}, \tag{1}$$

where $K_1$ is the thermoconductance, $A_1$ is an area equal to t×an axial length (parallel to the electrodes), and H is the thermoconductivity expressed in terms of (Btu/degree F. sec) (IN/in$^2$). The thermoconductance in the t or thickness direction may be expressed as:

$$K_t = H\frac{A_t}{t}, \tag{2}$$

where $A_t$ is an area equal to 1×an axial length. In comparing $K_t$ to $K_1$ by dividing, the term comprising the axial length along the PTC mass cancels. Therefore, thermoconductances may be compared as an expression of 1/t. More specifically, $$\frac{K_t}{K_1} = \left(\frac{1}{t}\right)^2 \tag{3}$$

Thus, it has been found that by decreasing the 1/t ratio, the heater exhibits improved thermoconductance in the 1 direction thereby reducing the possibility of the formation of hotlines.

A suitable strip heater comprised of carbon black dispersed in a polymeric base has an 1 of about 0.56 cm, a t of about 0.19 cm and an 1/t ratio of about 3.0. While the thermoconductance of various polymeric compositions may vary, in the case of compositions containing carbon black, the thermoconductivity does not vary to such a degree so as to necessitate varying a preferred ratio. However, if the thermoconductivity of a particular material is slightly higher than another material, it may be desired to construct the heater having a slightly larger 1/t ratio.

In an alternate embodiment of the present invention the web is constructed so that t is larger in the center than on the lateral edges of the strip. In such an embodiment, a mean value of t may be used to determine the 1/t ratio.

While an embodiment and application of the present invention has been shown and described, it should be apparent to those skilled in the art that many more modifications are possible without departing from the inventive concepts herein described. The invention, therefore, is not to be restricted except by the spirit of the appended claims.

I claim:

1. A self-regulating PTC strip heater comprising two parallel spaced-apart rod-like electrodes embedded in and enclosed by a web of PTC material which consists of an extruded homogenous mixture comprising carbon black dispersed in a polymeric material, said web of PTC material having a generally rectangular cross-section and having a generally retangular cross-section between the electrodes and having a substantially constant thickness t, said thickness t being greater than the maximum dimension of the electrodes in the same direction, and said electrodes being spaced apart by a distance 1 such that the ratio 1/t is from about 3/1 to 5/1, the current path between said electrodes always being exclusively in said web of PTC material.

2. A self-regulating PTC strip heater comprising two parallel spaced-apart rod-like electrodes embedded in and enclosed by a web of PTC material which consists of an extruded homogenous mixture comprising carbon black dispersed in a polymeric material, said web of PTC material having a generally elliptical cross-section and having a generally rectangular cross-section between the electrodes and having a substantially constant thickness t, said thickness t being greater than the maximum dimension of the electrodes in the same direction, and said electrodes being spaced apart by a distance 1 such that the ratio 1/t is about 3/1 to 5/1, the current path between said electrodes always being exclusively in said web of PTC material.

* * * * *